United States Patent [19]

Anjou

[11] 4,401,210

[45] Aug. 30, 1983

[54] CHILD-PROOF CONTAINER

[75] Inventor: Gunnar Anjou, Västra Frölunda, Sweden

[73] Assignee: Safe Package AB, Gothenburg, Sweden

[21] Appl. No.: 324,974

[22] Filed: Nov. 25, 1981

[30] Foreign Application Priority Data

Nov. 27, 1980 [SE] Sweden ..... 8008311

[51] Int. Cl.[3] ..... A45C 13/10

[52] U.S. Cl. ..... 206/1.5; 220/281; 220/306; 220/347; 206/807

[58] Field of Search ..... 220/281, 347, 346, 345, 220/306, 351; 206/1.5, 528, 807

[56] References Cited

U.S. PATENT DOCUMENTS 3,907,103 8/1975 Shaw ..... 220/281

4,174,034 11/1979 Itoo ..... 220/281

4,364,488 12/1982 Anjou ..... 220/281

*Primary Examiner*—Joseph Man-fu Moy

*Attorney, Agent, or Firm*—Holman & Stern

[57] ABSTRACT

A child-proof container consisting of a casing (2) and a box (3) displaceably arranged therein, whereby the side walls (2*a*) of the casing at the interior are provided with locking members (4, 5) located diagonally to each other and intended to cooperate with recesses (6) in the side walls of the box, whereby the locking members are arranged to be able to be moved away from locking position in the recesses by means of external forces (A, B), which can be applied with two fingers diagonally on the casing to give this a rhomboidic shape, whereby at the same time a pressure force (C) exerted by a third finger can push the box out of the container. (FIG. 3)

6 Claims, 7 Drawing Figures

CHILD-PROOF CONTAINER

Figure 1:
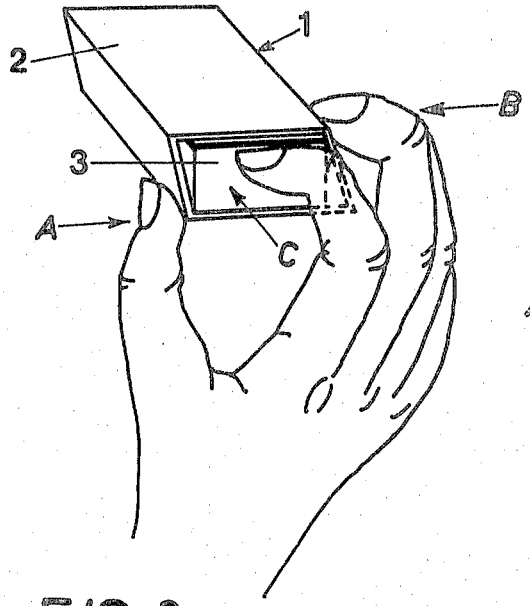

The present invention refers to a child-proof container of the type comprising a box, which is displaceable in a casing and with locking members adapted to lock the box to the casing in the position where the box is entirely pushed into the casing, said locking members being releasable from their locking positions.

Child-proof containers, i.e. containers which at least small children can not open are desirable for a plurality of goods, which could be harmful to the children could and/or to the surroundings. Such goods can e.g. be medical pills, matches, needles etc.

For such purposes it has earlier been developed more or less well functioning child-proof containers. In most cases these containers are formed with ledge-shaped locking members projecting from the flat side surface of the casing, but such locking members have generally only a very modest locking ability which can often be overcome without big forces, just by pushing the box in its normal direction of opening, and this can often also be accomplished by small children.

At one earlier known child-proof container it has however been suggested to use a casing which on the interior of one of its flat side surfaces has cams projecting into the casing, which cams in unloaded condition extend well inside the short side walls of the box and which flat side surface by compression of the casing long side walls in the area of the cams, can be brought to form an arc which means that the cam is moved out of its locking engagement with the box end. A prerequisite for this design is that the cam-provided flat side surface of the casing is deformable to such an extent that the necessary bending can be achieved. This in turn means that the choice of casing material will be strictly limited and it is in practice only possible to use plastic material, and this will make the container more expensive.

Frequent bendings during the opening of the container will furthermore mean, in spite of the choice of material, that the casing, as time goes, will be so worn that its cams, due to the fatigue of the flat side surface, will remain on a level outside the box side also when the pressure forces have been relieved. The compression of this casing can furthermore be difficult also for older people with debilitated hand muscles.

The purpose of the invention is to provide a child-proof container of the type described hereabove, which functions well to safely prohibit opening by a person who is not familiar with the opening method and which container at the same time does not call for so hard material demands and so high forces for correct opening of the container, and this has been achieved thereby that the casing at the inner side of its long side walls is provided with projections, projecting inwards and forming said locking members, which are arranged to engage under locking into recesses in the long side walls of the box in the position where the box is entirely pushed into the casing, whereby said projections in the two opposite casing long sides are located mainly diagonally opposite to each other, whereby the casing is arranged, under influence of external pressure forces to be given a mainly rhomboidic cross-section, at least in the area of said projections in the purpose of releasing said projections from said recesses during the time of action of said pressure forces and thereby to allow the opening of the box.

The invention will hereinafter be further described with reference to the accompanying drawing.

FIG. 1 shows in perspective the opening of a child-proof container according to the invention.

Figure 3:
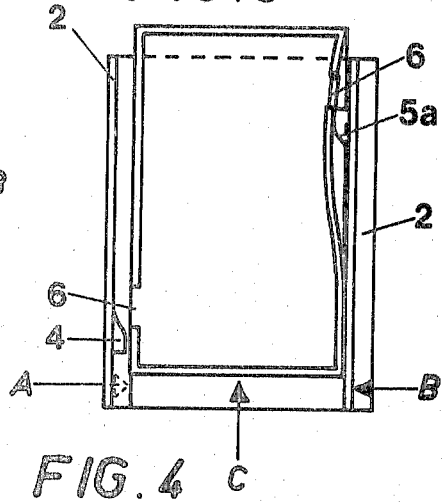
Figure 4:
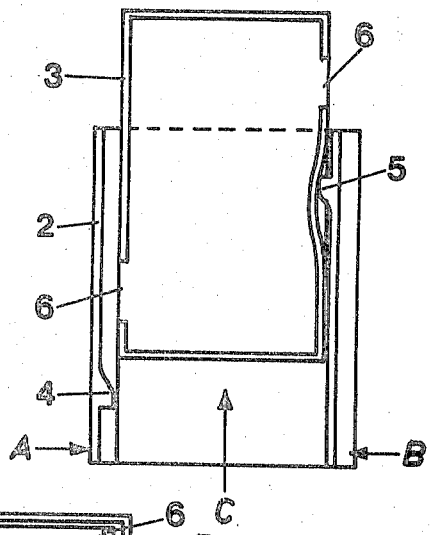
Figure 2:
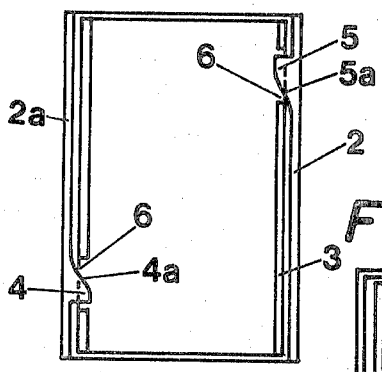
Figure 5:
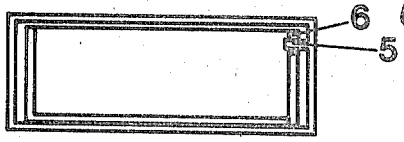
Figure 7:
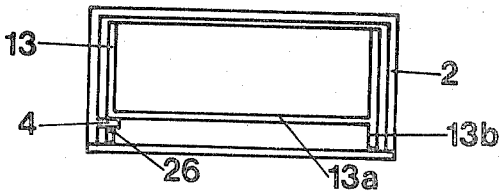
Figure 6:
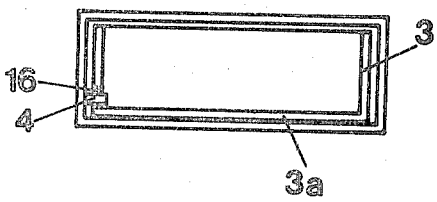

FIG. 2 shows a top view of a schematical cross-section of a container according to the invention wherein the section has been taken just above the locking members, and with the container in closed uninfluenced position, FIGS. 3 and 4 show in views corresponding to FIG. 2 the container according to FIG. 2 in different stages of opening, and FIGS. 5–7 show in schematic end views containers according to the invention with locking members located in different positions.

In FIG. 1 is shown in perspective a child-proof container 1 during the beginning of its opening process. The container incorporates a casing 2 which is open at both ends and a box 3 displaceably arranged therein. At the inner side of the long sides of the casing there is provided (but not visible in FIG. 1) locking members, which, in the rest position of the container, where it is not acted upon by outer forces, engage into recesses made in the side walls of the box long sides, whereby the locking members in this position prevent the box from being opened merely by being displaced in its normal direction of opening.

In order to open the container it is thereby necessary to cause the locking members to move out of their engagement with their associated recesses and it is furthermore necessary to push out the box in ordinary manner. This opening as shown in FIG. 1 is accomplished thereby the two fingers—preferably the thumb and the long finger—press in the directions of the arrows A and B against diagonally opposite edges of the casing, thus that the casing, at least in the area of the pressure forces, will get a mainly rhomboidic cross-section, which means that the locking member, which is situated in the area of pressure application, will be moved out of its locking position. With a further finger—preferably the index finger—it is hereby possible to displace the box 3 in the direction of arrow C out of the casing in ordinary manner. The opening of the container can thus easily be achieved with one hand only, which is important as the opening must not be difficult for a person familiar with the method.

In FIG. 2 is shown in a schematic plan view from above and in a section taken in level with the locking members, a container according to the invention in neutral, i.e. closed position, whereby the container is not acted upon by any external forces. The figure shows tha the casing 2 is provided with two locking members 4, 5, which are designed as cams projecting against the interior of the casing, and located one on each of the long side walls 2*a* of the casing diagonally relative to each other, each one adjacent each of the ends of the casing. The locking members catch in the neutral position into recesses 6 formed in the casing 3. Each locking member 4, 5 is preferably provided with a ramp-shaped surface 4*a*, 5*a* resp. which are inclined in a direction away from the adjacent casing short end, whereas its side facing said casing short end is preferably straignt.

The surfaces of the cam 4, 5 facing the resp. adjacent short end wall will in this position effectively prohibit the box from being displaced in either of the opening directions.

FIGS. 3 and 4 show in views corresponding to FIG. 2, different stages during the opening of the container, whereby FIG. 3 mainly corresponds to the position shown in FIG. 1, whereas FIG. 4 represents a later stage.

In FIG. 3 is shown how the pressure forces A and B, which are applied in positions diagonally opposed to each other, have brought the cam 4 out of engagement with the cooperating recess 6 in the box 3. The force C has displaced the box 3 from the engagement position and the other cam has simultaneously with its ramp-shaped surface 5*a* "climbed" out of its recess whereby the wall of the box has been somewhat deformed. In FIG. 4 and box 3 has been further displaced by means of force C, whereby the deformation of the box wall has been moved somewhat.

As can be seen from these views it is also necessary to give the casing its rhomboidic form in the correct direction in order to release the locking members. The container according to the invention is therefore easy to open for a person informed about the opening method but very difficult for a person who does not know about this method. The container is furthermore very difficult to open for small children even if the child knows the hand grips, which leave to be used, as these hand grips represent a simultaneous, complex movement which is known by experience to be difficult to manage for small children. Instructions about the opening method can preferably be written on the external surface of the container.

The cams 4, 5 are of course placed at the same level as the recesses 6, but this level can be varied such as shown in FIGS. 5–7, which show schematical end views, of which FIG. 5 shows an embodiment where the cam 5—like the not shown cam 4—lies just below the upper side of the casing 3. The recess 6 in the box 3 is in this case designed as a groove open against the open side of the box.

In FIG. 6 is shown an embodiment in which the recess 16 is arranged as a hole at a position just above the bottom 3*a* of the box. The casing is hereby the same as in the embodiment according to FIG. 5 with the difference that it is used in up-side-down position.

FIG. 7 finally shows a third embodiment in which the casing 2 is used in the same position as shown in FIG. 6, whereas the box 13 is provided with walls 13*b* drawn down below the bottom 13*a* of the box 13, whereby the the recesses 26 are located in this drawn-down wall portions. In this last-mentioned case it is possible to provide the box with an air and/or liquid proof seal, without risking that the function of the locking members is hampered or obstructed by such seal.

As the container can be opened in both directions, it will statistically seen be opened in each direction half of the opening times. As different material portions are acted upon for giving the casing its rhomboidic form in different opening directions the material of the casing will hereby also be subjected to less frequent occasions of actuation in the area of pressure forces than at the earlier embodiments which means that the risk for fatigue is reduced. The casing material can hereby be chosen from a number of different materials and it can e.g. consist of cardboard, whereas the locking members can be glued to, riveted to or attached in any other suitable manner to the cardboard casing. When using plastic or metallic casings the cams can be pressed directly out of the casing material.

The function of all the shown and intimated embodiments is the same as described above.

The invention is not limited to the embodiments shown in the drawing and described with reference thereto but modifications and variations are possible within the scope of the accompanying claims. The projections and the corresponding recesses can thus e.g. be located at any chosen level along the long sides of the container and the container can also be provided with double locking members whereby the container will have four projections located diagonally with reference to the width as well as to the length of the container.

What I claim is:

1. A child-proof container of the type comprising a box, which is displaceable in a casing and with locking members adapted to lock the box to the casing in the position where the box is entirely pushed into the casing said locking members being releasable from their locking positions, characterized thereby that the casing at the inner side of its long side walls is provided with projections, projecting inwards and forming said locking members, which are arranged to engage under locking into rcesses in the long side walls of the box in the position where the box is entirely pushed into the casing, whereby said projections in the two opposite casing long sides are located mainly diagonally opposite to each other, whereby the casing is arranged, under influence of external pressure forces (A,B) to be given a mainly rhomboidic cross-section, at least in the area of said projections in the purpose of releasing said projections from said recesses during the time of action of said pressure forces and thereby to allow the opening of the box.

2. A container as claimed in claim 1, wherein each projection is formed with ramp-like surfaces inclined in a direction away from the adjacent short side of the casing.

3. A container as claimed in claim 1 or 2, wherein the recesses in the box are located adjacent the open side of the box.

4. A container as claimed in claim 3, wherein the recesses are open against the upper sides of the box walls.

5. A container as claimed in claim 1 or 2, wherein the recesses in the box are located adjacent the bottom of the box.

6. A container as claimed in claim 5, wherein the box is provided with walls which extend below the bottom whereby said recesses are located in the walls below said bottom.

* * * * *